US010008776B2

(12) United States Patent
Chen et al.

(10) Patent No.: US 10,008,776 B2
(45) Date of Patent: Jun. 26, 2018

(54) WIDEBAND ANTENNA

(71) Applicant: Wistron NeWeb Corporation, Hsinchu (TW)

(72) Inventors: Chung-Hsuan Chen, Hsinchu (TW); Kuan-Chung Chen, Hsinchu (TW); Yung-Jen Cheng, Hsinchu (TW)

(73) Assignee: Wistron NeWeb Corporation, Hsinchu (TW)

( * ) Notice: Subject to any disclaimer, the term of this patent is extended or adjusted under 35 U.S.C. 154(b) by 193 days.

(21) Appl. No.: 14/874,484

(22) Filed: Oct. 5, 2015

(65) Prior Publication Data

US 2016/0164177 A1 Jun. 9, 2016

(30) Foreign Application Priority Data

Dec. 4, 2014 (TW) ..... 103221506 U

(51) Int. Cl.
*H01Q 5/30* (2015.01)
*H01Q 1/24* (2006.01)
*H01Q 5/378* (2015.01)

(52) U.S. Cl.
CPC ..... *H01Q 5/378* (2015.01); *H01Q 1/243* (2013.01)

(58) Field of Classification Search
CPC ..... H01Q 5/378; H01Q 5/385; H01Q 5/392
See application file for complete search history.

(56) References Cited

U.S. PATENT DOCUMENTS 6,650,294 B2 * 11/2003 Ying ..... H01Q 1/243 343/700 MS
9,077,066 B1 * 7/2015 Lee ..... H01Q 9/0407
9,431,705 B2 * 8/2016 Basirat ..... H01Q 9/42
2001/0050643 A1 * 12/2001 Egorov ..... H01Q 1/243 343/702
2004/0113845 A1 * 6/2004 Mikkola ..... H01Q 1/243 343/700 MS
2007/0069958 A1 * 3/2007 Ozkar ..... H01Q 9/0421 343/700 MS
2009/0237308 A1 * 9/2009 Tsai ..... H01Q 1/2266 343/700 MS
2010/0001908 A1 * 1/2010 Chen ..... H01Q 1/2266 343/700 MS
2011/0032165 A1 * 2/2011 Heng ..... H01Q 7/005 343/745
2014/0333504 A1 * 11/2014 Basirat ..... H01Q 9/42 343/893
2015/0102976 A1 * 4/2015 Wong ..... H01Q 1/243 343/860

(Continued)

*Primary Examiner* — Dameon E Levi
*Assistant Examiner* — Jennifer F Hu
(74) *Attorney, Agent, or Firm* — Winston Hsu

(57) ABSTRACT

A wideband antenna includes a grounding terminal, a first radiator disposed on a first plane, a feeding terminal formed on the first radiator, where the feeding terminal is to transmit and receive radio signals via the first radiator, and a second radiator disposed on the first plane, electrically connected to the grounding terminal, and including a part parallel to a side of the first radiator, wherein a minimum gap between the second radiator and the first radiator allows the second radiator and the first radiator to generate a coupling effect therebetween, so as to exchange radio signals between the second radiator and the first radiator.

10 Claims, 11 Drawing Sheets

(56) References Cited

U.S. PATENT DOCUMENTS

2015/0380820 A1* 12/2015 Wu ..... H01Q 9/42
343/702
2016/0164177 A1* 6/2016 Chen ..... H01Q 5/378
343/843

* cited by examiner

WIDEBAND ANTENNA

BACKGROUND OF THE INVENTION

1. Field of the Invention

The present invention relates to a wideband antenna, and more particularly, to a wideband antenna capable of achieving multiband or wideband operations, having good matching effect and adjustability, and reducing a required antenna size.

2. Description of the Prior Art

An antenna is utilized for transmitting or receiving radio frequency waves in order to communicate or exchange wireless signals. An electronic product with wireless communication functionality, such as a laptop and a personal digital assistant (PDA), usually accesses a wireless network through a built-in antenna. Therefore, to facilitate access to the wireless communication network, an ideal antenna should have a wide bandwidth and a small size to meet the trends of compact electronic products within a permissible range, so as to integrate the antenna into a portable wireless communication equipment. In addition, as wireless communication technology evolves, operating bands of wireless communication systems become various. Therefore, an ideal antenna should cover various frequency bands.

Nowadays, the most common antennas of wireless communication include various types such as inverted-F antenna, loop antenna, couple antenna, etc. The inverted-F antenna, as its name implies, has a shape similar to a rotated and inverted character "F". Nevertheless, performances of the inverted-F antenna in terms of bandwidth and bandwidth efficiency are not good, especially in low-frequency bands. Therefore, additional metal segments are usually supplemented in its vertical direction. Consequently, the cost will be increased. Since the resonating length of a loop antenna, theoretically, needs to be one half of the wavelength, and the operating bands of the loop antenna are too narrow, loop antennas are unlikely to be applied to wideband applications. The couple antenna utilizes the coupling effect between components to resonate the required frequency band. However, the frequency bands are not easy to be adjusted.

Therefore, how to increase antenna bandwidths to meet wideband requirements of wireless communication systems with, such as long term evolution (LTE) systems, is an ultimate goal in this technical field.

SUMMARY OF THE INVENTION

A primary aspect of the present invention is to provide a wideband antenna, and to be capable of achieving multiband or wideband operations, having good matching effect and adjustability, reducing a required antenna size, and satisfying different system requirements.

An embodiment of the present invention discloses a wideband antenna, including a grounding terminal; a first radiator, disposed on a first plane; a feeding terminal, formed on the first radiator, where the feeding terminal is to transmit and receive radio-frequency (RF) signals via the first radiator; and a second radiator, disposed on the first plane, electrically connected to the grounding terminal, including a part parallel to a side of the first radiator, where a minimum gap between the second radiator and the first radiator allows the second radiator and the first radiator to generate a coupling effect therebetween to deliver RF signals.

These and other objectives of the present invention will no doubt become obvious to those of ordinary skill in the art after reading the following detailed description of the preferred embodiment that is illustrated in the various figures and drawings.

DETAILED DESCRIPTION

Figure 1:
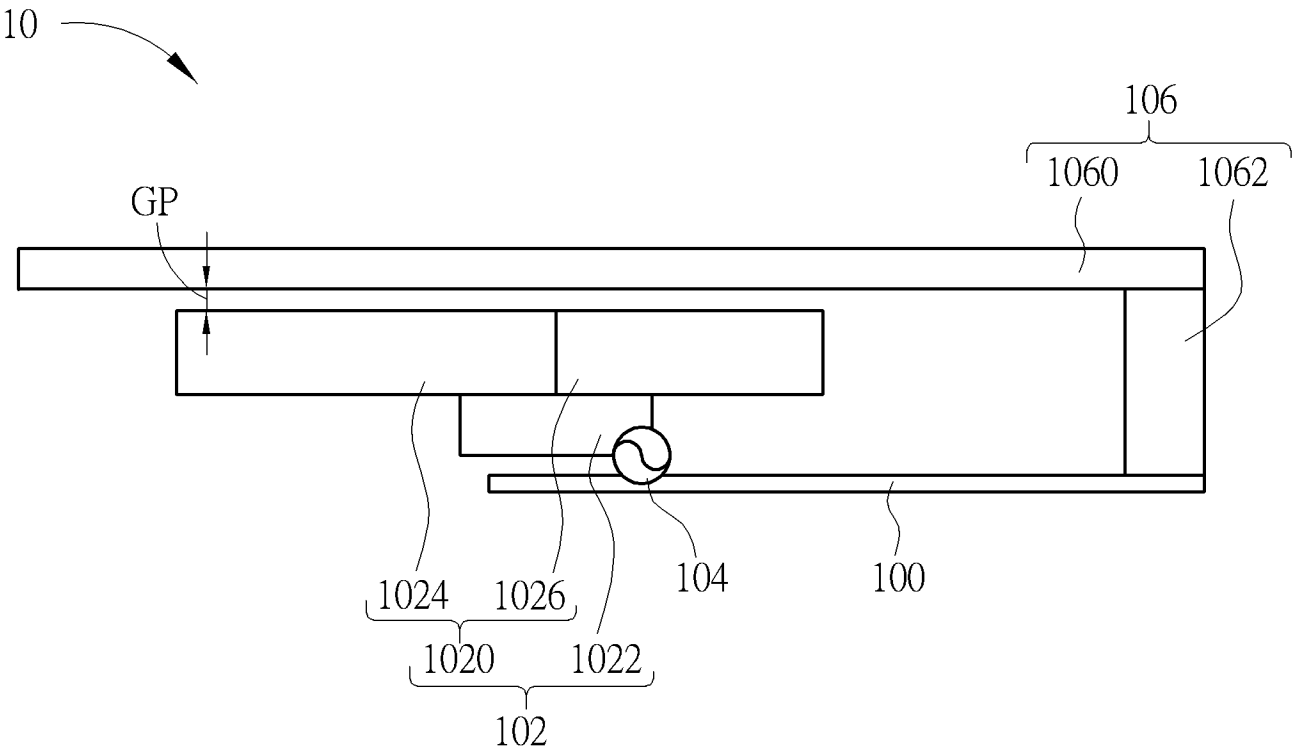
FIG. 1 is a schematic diagram of a wideband antenna according to an embodiment of the present invention.

Please refer to FIG. 1, which is a schematic diagram of a wideband antenna 10 according to an embodiment of the present invention. The wideband antenna 10 includes a grounding metal segment 100, a first radiator 102, a feeding terminal 104, and a second radiator 106. The wideband antenna 10 may achieve wideband operation, so as to satisfy wideband requirements of wireless communication system such as long term evolution (LTE) system. The grounding metal segment 100 can be a long metal segment for providing grounding. The grounding metal segment 100 may be made of metal materials such as grounding copper, etc., in various forms and shapes. The first radiator 102 structurally includes a first metal segment 1020 and a second metal segment 1022, which are electrically connected to each other. The first metal segment 1020 may include a first sub-segment 1024 and a second sub-segment 1026. The first radiator 102 may be made in one piece. Similarly, the second radiator 106 structurally includes a third metal segment 1060 and a fourth metal segment 1062, which are electrically connected to each other. The fourth metal segment 1062 is electrically connected to the grounding metal segment 100. The second radiator 106 and the grounding metal segment 100 may be made in one piece. The feeding terminal 104 is formed on the second metal segment 1022 of the first radiator 102, for letting radio-frequency (RF) signals being transmitted and received via the first radiator 102. In addition, as shown in FIG. 1, a part of the third metal segment 1060 is parallel to the first metal segment 1020, i.e., a part of the second radiator 106 is parallel to a side of the first radiator 102, and a minimum gap GP between the second radiator 106 and the first radiator 102 allows the second radiator 106 and the first radiator 102 to generate a coupling effect therebetween, thereby delivering RF signals.

In short, the wideband antenna 10 of the present invention directly feeds RF signals to the first radiator 102 via the feeding terminal 104, and the RF signals are delivered by the coupling effect between the first radiator 102 and the second radiator 106. In this case, by adjusting lengths of the first radiator 102 and the second radiator 106, and the gap GP, etc., of the present invention, multiband or wideband operations may be achieved, and with a good matching effect as well.

For example, the first radiator 102 is a directly feed-in monopole antenna. Distances from the feeding terminal 104 to the two ends of the first metal segment 1020 (i.e., approximately the total length of the second metal segment 1022 and the first sub-segment 1024, and the total length of the second metal segment 1022 and the second sub-segment 1026, respectively) may be designed as a quarter of a wavelength in accordance with the received and transmitted RF signals, so as to achieve multiband or wideband operations. In an embodiment, the total length of the second metal segment 1022 and the first sub-segment 1024 is substantially equal to a quarter of a wavelength in accordance with a first frequency band, and the total length of the second metal segment 1022 and the second sub-segment 1026 is approximately equal to a quarter of a wavelength in accordance with a second frequency band. For example, for LTE systems, the first frequency band is substantially between 1575 MHz and 1900 MHz, and the second frequency band is substantially between 1900 MHz and 2300 MHz, so as to meet high frequency requirements of LTE systems. The 1575 MHz frequency band may be used in global positioning systems. Furthermore, a total length of the third metal segment 1060 of the second radiator 106 and the fourth metal segment 1062 may be adjusted to be approximately equal to a quarter of a wavelength in accordance with a third frequency band, so as to transmit and receive RF signals of the third frequency band. Moreover, for LTE system, the third frequency band is substantially between 704 MHz and 960 MHz.

Figure 2A:
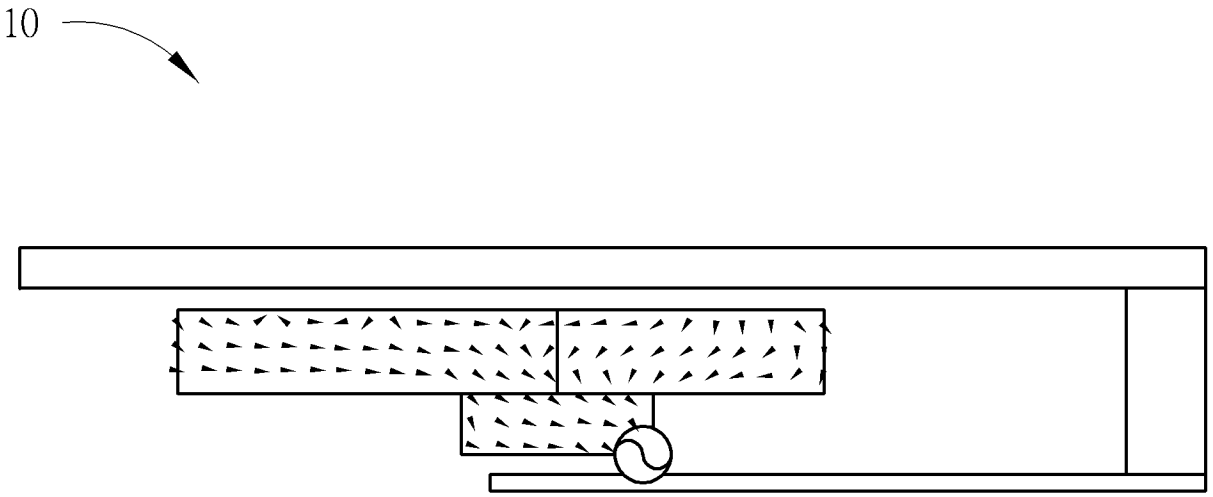
FIG. 2A to 2C are schematic diagrams of the electrical current distribution of the wideband antenna of FIG. 1 operating at different frequency bands according to an embodiment of the present invention.
Figure 2B:
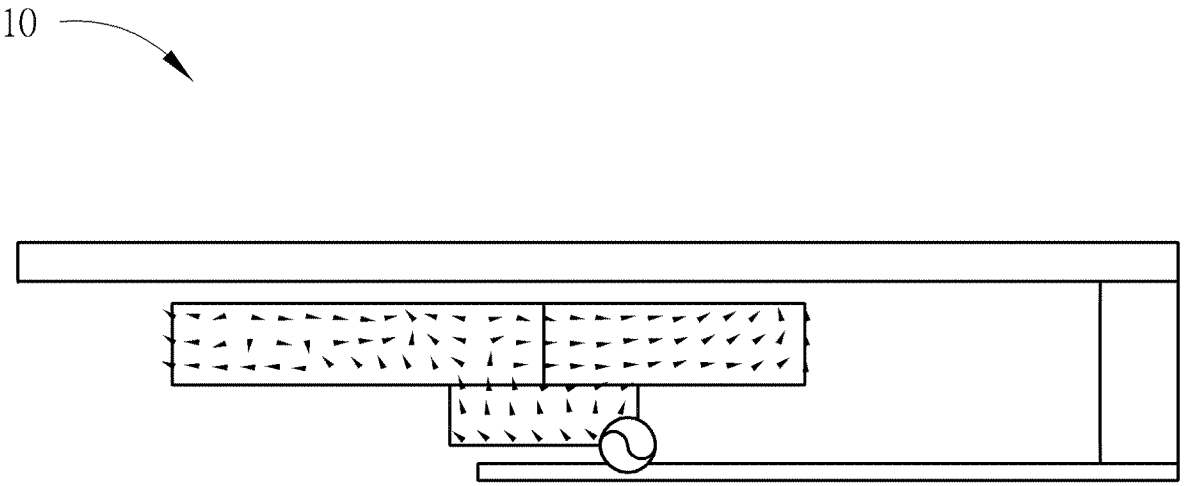
Figure 2C:
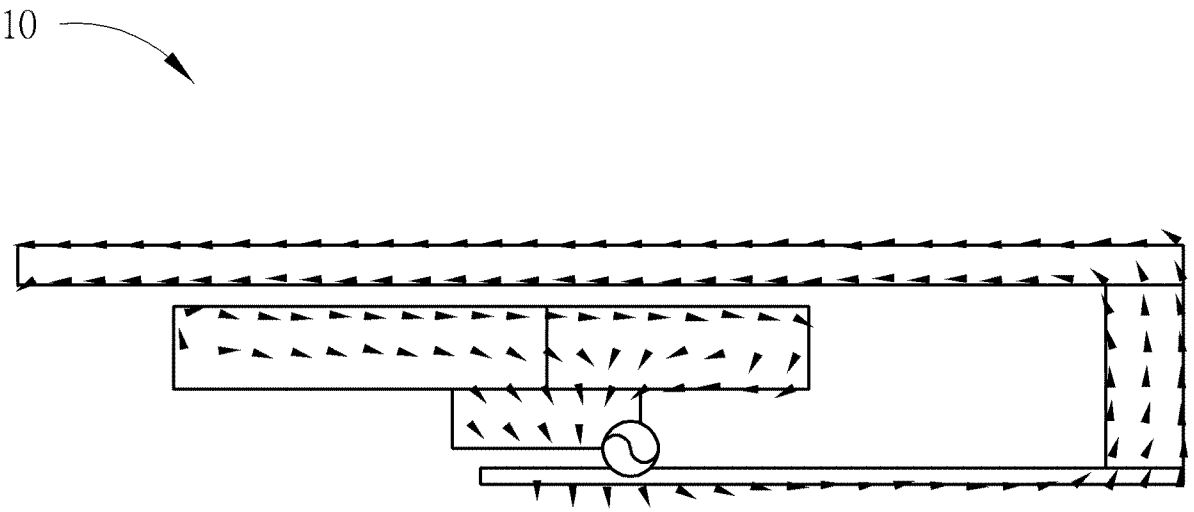
Figure 2D:
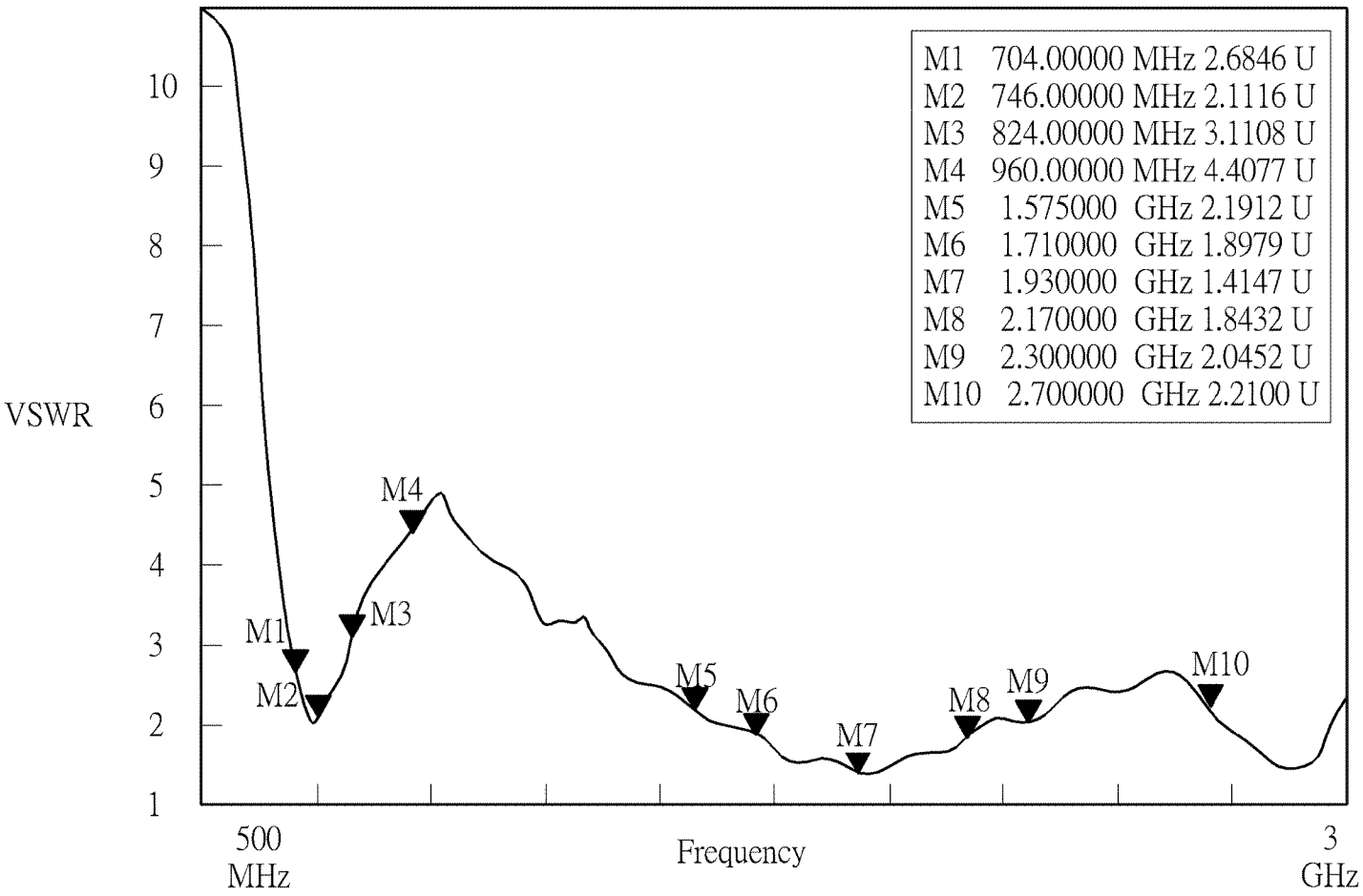
FIG. 2D is a schematic diagram of the voltage standing wave ratio (VSWR) of the wideband antenna of FIG. 1.

Operations of the wideband antenna 10 may be referred to FIGS. 2A to 2D. In which, FIG. 2A to 2C are schematic diagrams illustrating current distributions of the wideband antenna 10 operating at the first frequency band (1575 MHz-1900 MHz), the second frequency band (1900 MHz-2300 MHz), and the third frequency band (704 MHz-960 MHz), respectively. FIG. 2D is a schematic diagram illustrating the voltage standing wave ratio (VSWR) of the wideband antenna 10. Referring to FIG. 2A to 2C, the wideband antenna 10 transmits and receives the RF signals of the first frequency band and the second frequency band via the first radiator 102 by direct feed-in, and transmits and receives the RF signals of the third frequency band via the second radiator 106 by coupling, so as to achieve multiband and wideband operations shown in FIG. 2D. Meanwhile, since the first radiator 102 partially couples with the second radiator 106, a resonating frequency of the second radiator 106 may be shifted toward low-frequency side, which may contribute to a bandwidth of low-frequency band, thereby significantly reducing the length required for the second radiator 106 and therefore achieving a purpose of reducing antenna size. As a result, by adjusting the lengths of the first radiator 102 and the second radiator 106, the wideband antenna 10 may achieve multiband and wideband operations and reduce the antenna size. In another perspective, the gap GP is smaller than or equal to 3 mm, which depends on the coupling between the first radiator 102 and the second radiator 106. Impedance matching between the first radiator 102 and the second radiator 106 may be adjusted by adjusting the gap GP, so as to enhance radiation efficiency. In addition to the length of the first radiator 102, the length of the second radiator 106 and the gap GP, other adjustable factors such as the widths of the first radiator 102 and the second radiator 106, the ways of bending, the numbers of branches, may all be modified according to practical system requirements by those skilled in the art. Moreover, in FIG. 1, the wideband antenna 10 is substantially disposed on a same plane, which may be further deployed on a substrate or formed on a circuit board by etching, to simplify production process, but is not limited thereto.

Furthermore, to increase radiation region of the low-frequency band and to greatly shorten the length of the radiator, the present invention provides an extra low-frequency current path, based upon the structure of the wideband antenna 10. Please refer to FIGS. 3A, 3B, which are schematic diagrams of a front side and a back side of a wideband antenna 30, respectively, according to an embodiment of the present invention. The wideband antenna 30 is derived from the wideband antenna 10, and thus, the same components are denoted by the same numerals. By comparing FIG. 1 and FIGS. 3A, 3B, the grounding metal segment 100, the first radiator 102, the feeding terminal 104 and the second radiator 106 of the wideband antenna 10 is disposed on a first plane A of a substrate 300, and a third radiator 304 is further included and disposed on a second plane B (parallel to the first plane A) of the substrate 300. The second radiator 106 and the third radiator 304 are electrically connected through vias 302.

Figure 3A:
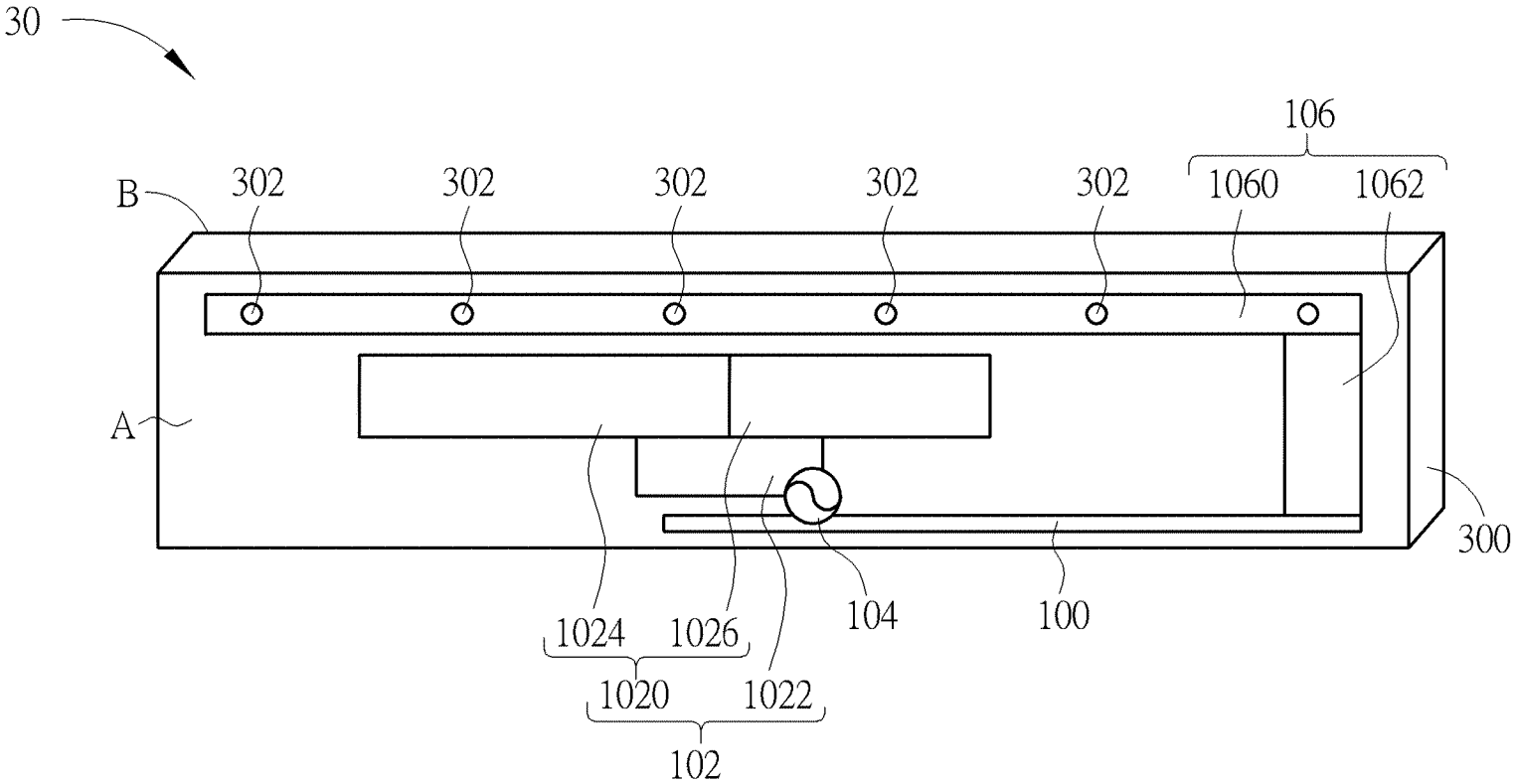
FIG. 3A, 3B are schematic diagrams of a front side and a back side of a wideband antenna according to an embodiment of the present invention.
Figure 3B:
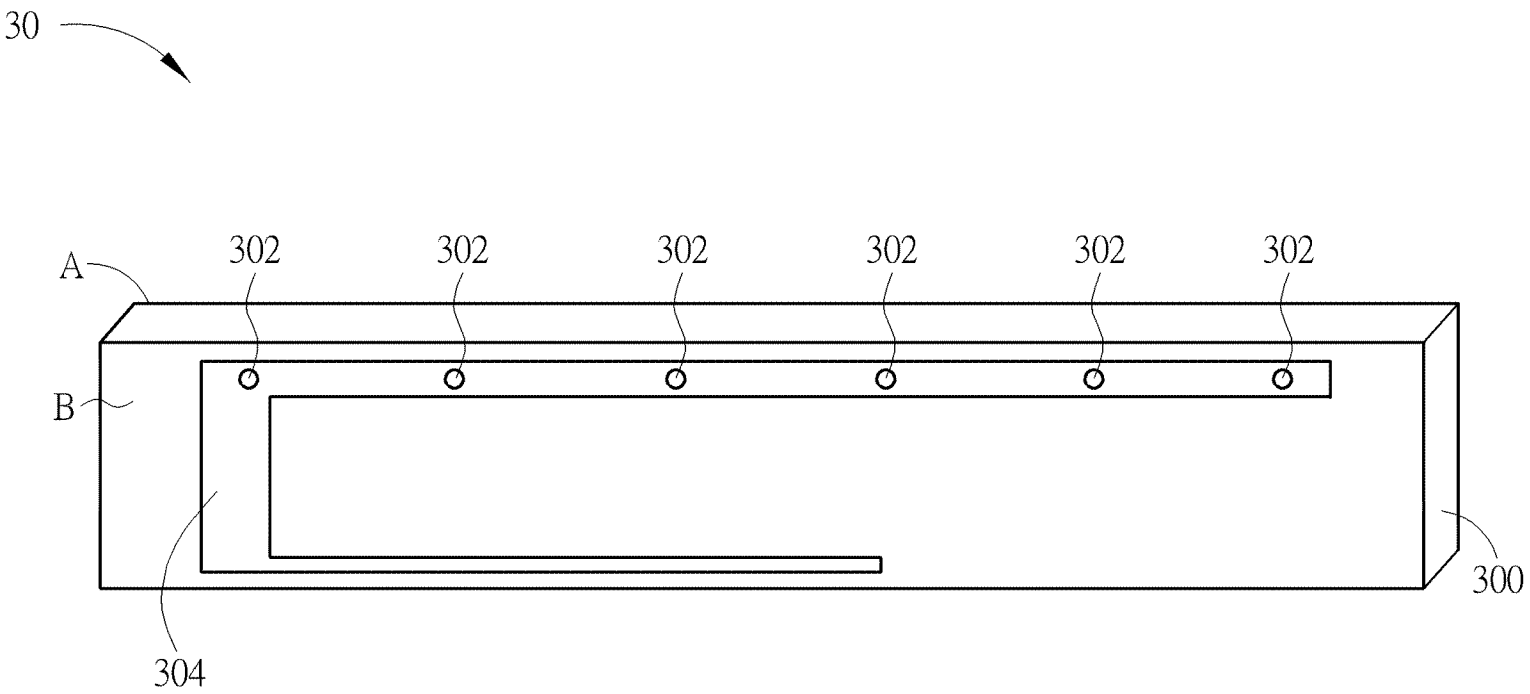
Figure 4:
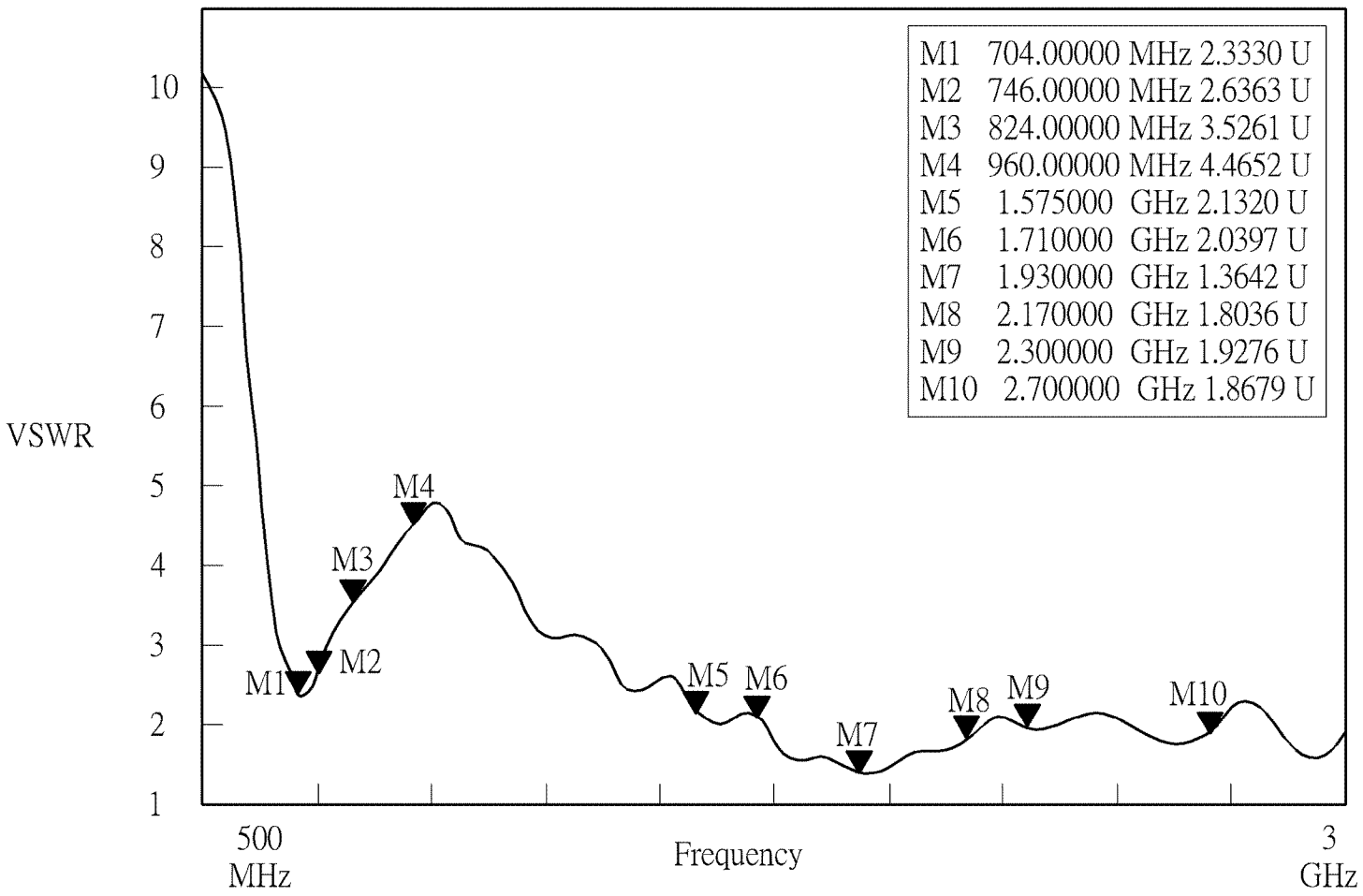
FIG. 4 is a schematic diagram of the VSWR of the wideband antenna of FIG. 3A, 3B.

In short, the wideband antenna 30 is a double-sided (or multi-layer) structure. The wideband antenna 10 is disposed on one side (the first plane A) of the wideband antenna 30, and the third radiator 304 is disposed on the other side (the second plane B). The third radiator 304 and the second radiator 106 are electrically connected through the vias 302. In addition, as shown in FIGS. 3A, 3B, the shapes and the locations of the third radiator 304 and the second radiator 106 are similar. In other words, the projection of the third radiator 304 on the first plane A substantially overlaps with the second radiator 106. In this case, the third radiator 304 may transmit and receive signals of the same operating frequency band (e.g., 704 MHz-960 MHz) as the second radiator 106, so as to increase the radiation region of the low-frequency band and to enhance low-frequency bandwidth and efficiency. Related VSWR scheme diagram of the wideband antenna of this embodiment may be referred to FIG. 4.

Notably, in the wideband antenna 30, the third radiator 304 and the second radiator 106 have substantially the same shapes, but are not limited thereto. Those skilled in the art may reasonably modify the length or shape of the third radiator 304, so as to transmit and receive RF signals of specific frequency bands or to change matching condition, which is also included within the scope of the present invention. In another perspective, the wideband antenna 30 has the same structure as the wideband antenna 10, and thus same as the operations and advantages of the wideband antennas 10 and 30, which may be referred to the above paragraphs and will not be repeated herein.

Figure 5:
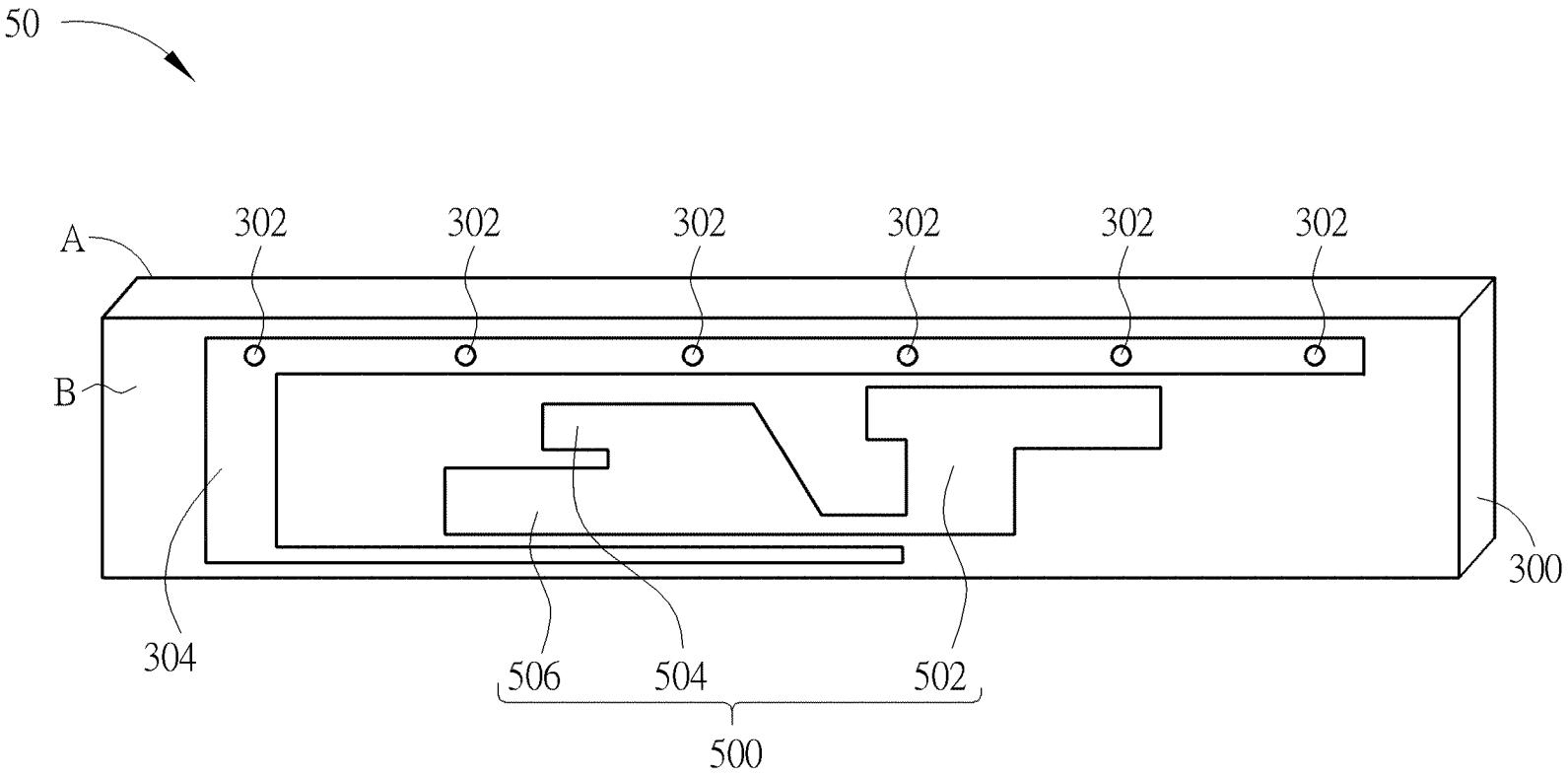
FIG. 5 is a schematic diagram of a back side of a wideband antenna according to an embodiment of the present invention.

In addition to increasing the radiation region of the low-frequency band, a high-frequency coupling parasitic component may be further included if a high-frequency bandwidth needs to be expanded. Please refer to FIG. 5, which is a schematic diagram of a back side of a wideband antenna 50 according to an embodiment of the present invention. The wideband antenna 50 is derived from the wideband antenna 30. The front side of the wideband antenna 50 (i.e., the first plane A) is same as the wideband antenna 30 shown in FIG. 3A and will not be repeated herein. In the back side (i.e., the second plane B) of the wideband antenna 50, same components are denoted as the same numerals as well. By comparing FIG. 5 and FIG. 3B, the wideband antenna 50 further includes a fourth radiator 500 disposed on the second plane B of the wideband antenna 30. In the current embodiment, the fourth radiator 500 substantially includes three blocks 502, 504, 506. The location where the fourth radiator 500 is disposed at needs to be capable of generating coupling effect between the fourth radiator 500 and the first radiator 102. In other words, the projection of the fourth radiator 500 on the first plane A would partially overlap with the first radiator 102, to make sure that the fourth radiator 500 is capable of generating coupling effect together with the first radiator 102 so as to deliver RF signals. Further, the first radiator 102 is electrically connected to the feeding terminal 104 by direct feed-in, and the fourth radiator 500 is coupled to the first radiator 102 by coupling. Therefore, compared to the wideband antenna 10 and 30, the wideband antenna 50 may expand high-frequency current path and resonate more modes in high-frequency bands, so as to expand high-frequency bandwidth. Moreover, the blocks 502, 504, 506 are substantially related to high-frequency modes, and the shapes and where they are disposed may be adjusted to meet system requirements. For example, in an embodiment, the blocks 502, 504 are used to activate modes between 1400 MHz and 1575 MHz, and the block 506 is utilized to activate modes between 2700 MHz and 3200 MHz. Notably, the number and the shapes of the blocks included in the fourth radiator 500 may be properly modified by one of skilled in the art, and should not be limited to those described.

Figure 6A:
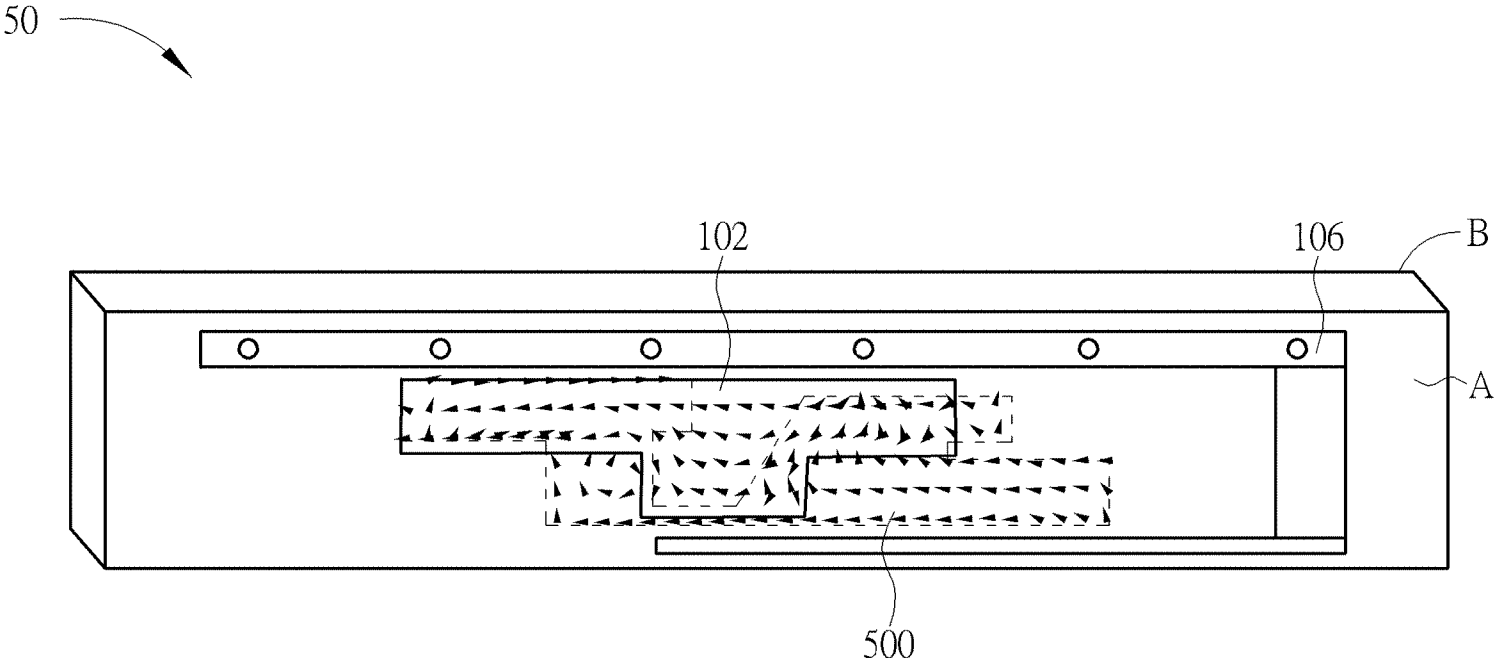
FIG. 6A is a schematic diagram of the electrical current distribution of the wideband antenna of FIG. 5 operating at high-frequency bands according to an embodiment of the present invention.
Figure 6B:
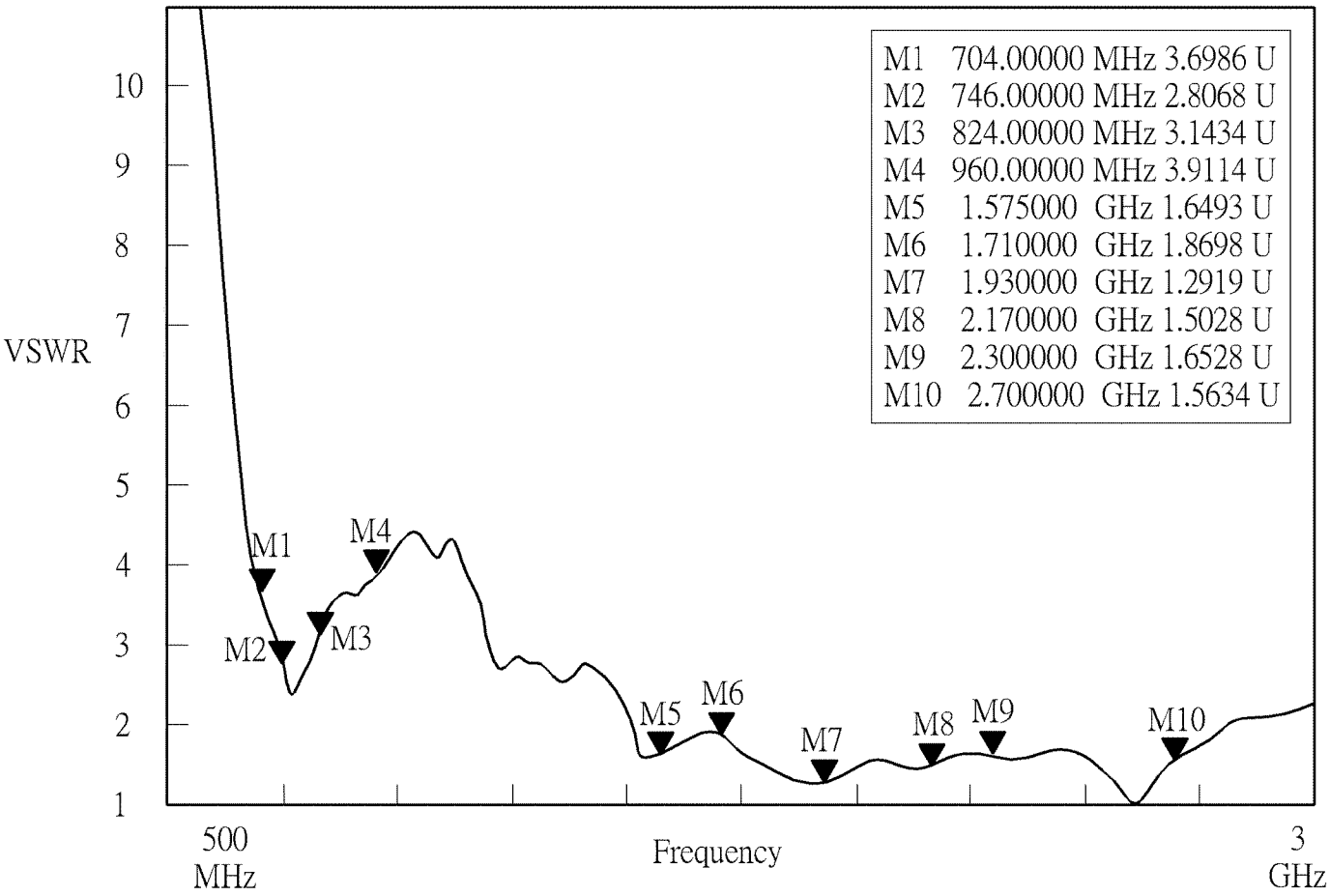
FIG. 6B is a schematic diagram of the VSWR of the wideband antenna of FIG. 5.

In addition, similar to the first radiator 102, the fourth radiator 500 may be partially coupled with the second radiator 106 or the third radiator 304, the resonating frequency of the second radiator 106 or the third radiator 304 may be shifted toward the low frequency side, which may also contribute to a bandwidth of low-frequency band, thereby significantly reducing the length required for the second radiator 106 or the third radiator 304 and therefore achieving the purpose of reducing antenna size. Operations of the wideband antenna 50 may be referred to FIGS. 6A, 6B. FIG. 6A is a schematic diagram of electrical current distribution of the wideband antenna 50 operating in high-frequency band, in which most numerals of components are not illustrated for brevity. FIG. 6B is a schematic diagram of VSWR of the wideband antenna 50. As can be seen from FIG. 6A, the fourth radiator 500 may generate coupling effect with the first radiator 102, so as to increase high-frequency bandwidth and radiation efficiency, see FIG. 6B.

Notably, the wideband antenna 50 is derived from the wideband antenna 30. The fourth radiator 500 is disposed in different region on the plane of the third radiator 304 (the second plane B), and is not electrically connected to the third radiator 304. Nevertheless, it is not limited thereto. The fourth radiator 500 and the third radiator 304 may be disposed independently, or be disposed on different layers. That is, in some embodiments, the fourth radiator 500 can be included in the wideband antenna 10 without disposing the third radiator 304. Additionally, the present invention may include a multi-layered substrate, where the wideband antenna 10, the third radiator 304, and the fourth radiator 500 can be respectively disposed on those different layers.

In summary, the wideband antenna of the present invention may achieve multiband or wideband operations, good matching effect and adjustability, and may significantly reduce the antenna size to meet different system requirements.

Those skilled in the art will readily observe that numerous modifications and alterations of the device and method may be made while retaining the teachings of the invention. Accordingly, the above disclosure should be construed as limited only by the metes and bounds of the appended claims.

What is claimed is:

1. A wideband antenna, comprising:

a grounding terminal, disposed on a first plane;

a first radiator, disposed on the first plane;

a feeding terminal, formed on the first radiator, wherein the feeding terminal is to transmit and receive radio-frequency (RF) signals via the first radiator;

a second radiator, disposed on the first plane, electrically connected to the grounding terminal, and comprising a part parallel to a side of the first radiator, wherein a minimum gap between the second radiator and the first radiator allows the second radiator and the first radiator to generate a coupling effect therebetween to deliver RF signals, wherein a surface of the second radiator and a surface of the first radiator are located on the first plane;

a third radiator, disposed on a second plane, wherein the second plane is parallel to the first plane, the projection result of the third radiator on the first plane overlaps with the second radiator, and a first shape formed by the second radiator and the grounding terminal is the same as a second shape of the third radiator; and at least one via, located between the second radiator and the third radiator, wherein the at least one via is electrically connected between the second radiator and the third radiator;

wherein the first radiator comprises a first metal segment and a second metal segment, and the second metal segment is electrically connected between the first metal segment and the feeding terminal;

wherein the second metal segment extends toward a direction which is parallel to the part of the second radiator and the side of the first radiator;

wherein the part of the second radiator is parallel to the first metal segment, and is parallel to the side of the first radiator.

2. The wideband antenna of claim 1, wherein the first metal segment comprises a first sub-segment and a second sub-segment, the total length of the first sub-segment and the second metal segment is related to the wavelength of an RF signal corresponding to a first frequency band, and the total length of the second sub-segment and the second metal segment is related to a wavelength of an RF signal corresponding to a second frequency band.

3. The wideband antenna of claim 2, wherein the first frequency band is between 1575 MHz and 1900 MHz, and the second frequency band is between 1900 MHz and 2300 MHz.

4. The wideband antenna of claim 1, wherein the second radiator comprises:

a third metal segment; and a fourth metal segment, electrically connected between the third metal segment and the grounding terminal;

wherein the third metal segment is parallel to the side of the first radiator.

5. The wideband antenna of claim 4, wherein the total length of the third metal segment and the fourth metal segment is related to the wavelength of an RF signal corresponding to a third frequency band.

6. The wideband antenna of claim 5, wherein the third frequency band is between 704 MHz and 960 MHz.

7. The wideband antenna of claim 1, further comprising:

a fourth radiator, disposed on a third plane, wherein the third plane is parallel to the first plane;

wherein the projection of the fourth radiator on the first plane partially overlaps with the first radiator, whereby the fourth radiator and the first radiator generate a coupling effect therebetween to deliver RF signals.

8. The wideband antenna of claim 7, wherein the second plane and the third plane are located in different regions on a same plane, and the third radiator and the fourth radiator are not electrically connected.

9. The wideband antenna of claim 7, wherein the second plane and the third plane are different planes.

10. The wideband antenna of claim 1, wherein the minimum gap is smaller than or equal to 3 mm.

* * * * *